United States Patent [19]

Weiss

[11] 4,069,997

[45] Jan. 24, 1978

[54] WASTE RECEPTACLE CAM LOCK WITH LOCKING PROJECTION

[76] Inventor: Sam Weiss, 14th & Laurel Sts., Pottsville, Pa. 17901

[21] Appl. No.: 730,640

[22] Filed: Oct. 7, 1976

[51] Int. Cl.[2] ..... B65F 1/00

[52] U.S. Cl. ..... 248/203; 248/313; 248/DIG. 7; 292/67

[58] Field of Search ..... 248/203, 313, DIG. 7, 248/418; 292/67; 211/4

[56] References Cited

U.S. PATENT DOCUMENTS

| | | | |
|---|---|---|---|
| 1,226,968 | 5/1917 | Guenther | 248/203 |
| 2,651,053 | 9/1953 | Rowe | 292/67 X |
| 3,053,495 | 9/1962 | Schmier | 248/313 |
| 3,599,924 | 8/1971 | Schmidgall | 248/418 |
| 3,655,158 | 4/1972 | Smith | 248/DIG. 7 |

FOREIGN PATENT DOCUMENTS

| | | | |
|---|---|---|---|
| 90,236 | 8/1957 | Norway | 297/67 |

*Primary Examiner*—Francis K. Zugel

*Attorney, Agent, or Firm*—Clarence A. O'Brien; Harvey B. Jacobson

[57] ABSTRACT

A waste receptacle cam lock with locking projection is provided to prevent the unauthorized removal of the waste receptacle from the mounting and supporting bracket. The cam lock associated with the primary supporting bracket and rotatably mounted from said bracket is spring biased such that when rotated to the position in which it functions as a cam to lock a secondary bracket as attached to the waste receptacle in the lock position, the spring biasing will effect a longitudinal movement of the cam disc and positively cause a projection extending from an edge thereof to interlock with a portion of the primary support bracket. Thus, the cam lock will be positively locked in closed position until such time as an operator with a proper actuating key positively and forceably moves the cam member with its mounting shaft in a longitudinal direction against the spring bias in order to disengage the projection from the bracket support. Then, and only then, can the cam lock be disengaged from the locking position.

3 Claims, 6 Drawing Figures

WASTE RECEPTACLE CAM LOCK WITH LOCKING PROJECTION

BACKGROUND OF THE INVENTION

1. Field of the Invention

This invention relates generally to locking devices for waste receptacle support brackets, and especially to an improvement over U.S. Pat. No. 3,053,495, to Jacob Schmier.

2. Description of the Prior Art

A common problem with the above referenced patent of which this invention is an improvement thereover, is that the cam means that is rotatable eccentrically by a key shaft for locking the secondary support bar into the T-shaped slot of the primary support bracket for preventing removal or disengagement of the waste receptacle from said primary support bracket is in fact subject to undesirable unlocking due to vibration and the like. This cam means fails to provide or include structure for positively preventing the reverse rotation of same to an unlocking position. It has been found in actual use and practice that due to normal wear and tear, vibration and other disturbances from wind and perhaps just from trash being put into the waste receptacle, the cam locking means has a tendency to unlock or turn to the unlocked position. Even though the key is not attached to the key shaft which supports the cam structure, such unlocking action has often occurred.

This defeats the primary purpose of the bracket and locking structure associated therewith, and once the cam structure is in the unlocked position from whatever cause, the waste receptacle may be removed by unauthorized persons.

Known prior art patents which may be pertinent to this invention are as follows: U.S. Pat. Nos. 643,441, Oct. 10, 1899; 977,612, Dec. 6, 1910; 3,038,677, June 12, 1962; 3,266,765, Aug. 16, 1966; 3,568,966, Mar. 9, 1971; 3,662,979, May 16, 1972; 3,933,240, Jan. 20, 1976.

None of these known prior art devices offers the new and unique features of the invention disclosed herein.

SUMMARY OF THE INVENTION

An object of the present invention is to provide an easy and positive way of locking an outdoor waste receptacle in position on a primary bracket structure while the receptacle may be used for holding and retaining waste material, whereby unauthorized persons will not be able to remove the receptacle from its holder.

Another object of the present invention is to provide a primary bracket for a secondary support structure having a waste receptacle attached thereto together with a cam lock means with positive retention projection thereon for association with the structure of the primary bracket support to prevent inadvertent unlocking of said cam means and the associated waste receptacle.

A further object of this invention is to provide a simple and yet positive operating locking structure for use with waste receptacle supporting structure for preventing the unauthorized removal thereof either through purposeful action or inadvertent action.

The device of this invention is an improvement on the cam locking structure of U.S. Pat. No. 3,053,495, to Jacob Schmier, patented Sept. 11, 1962. This patent discloses a bracket structure for a waste receptacle wherein a secondary support structure attached in a positive manner to the waste receptacle is associated with said primary bracket through a T-shaped slot and together with cam means may be positively locked to the primary bracket. Normally, a key structure must be used in order to turn the cam means to either the unlocked position or the locked position. However, nothing is provided to prevent the cam structure from turning through vibration or other disturbances to an unlocked position. The improvement of this invention consists of restructuring the cam locking means so that it is spring biased in a longitudinal direction and providing an extending projection along one side of the cam structure which when the cam is in the lock position will through the spring biased action be positively forced into engagement with a portion of the primary support bracket. Thus, until such time as the cam structure is positively pushed against the spring bias to disengage the locking projection, the cam cannot be turned to the unlocked position and the waste receptacle together with its secondary support will remain in the locked position. Thus, either unauthorized removal of the waste receptacle by persons without authority to do so is prevented as well as inadvertent or accidental unlocking and disengagement of the waste receptacle from the primary support bracket.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
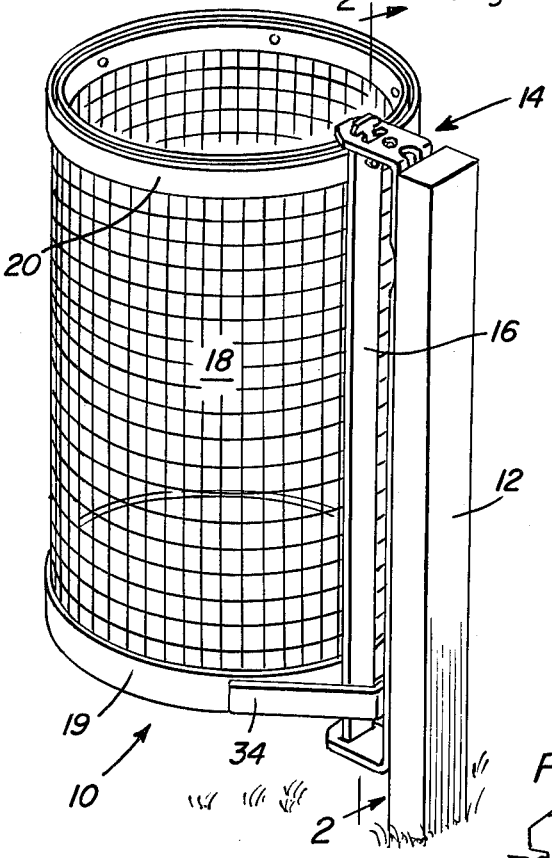
FIG. 1 is a perspective view of the outdoor waste receptacle and the primary and secondary support structure therefor.
Figure 2:
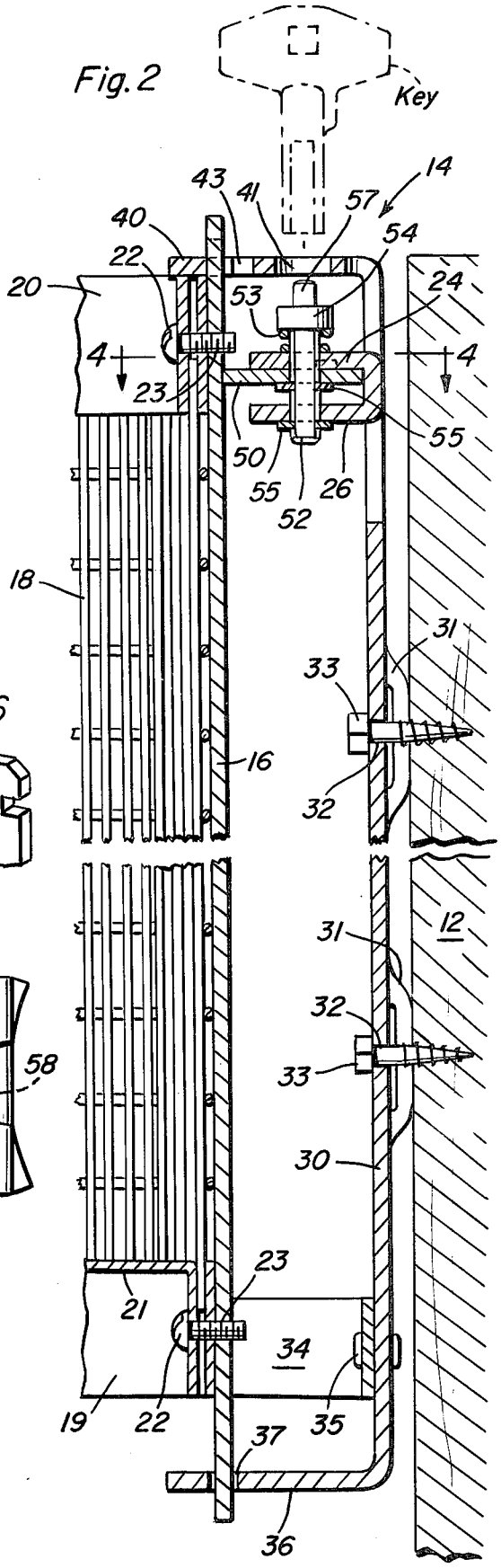
FIG. 2 is a side elevational view, partly in cross section, taken generally along line 2—2 of FIG. 1.
Figure 6:
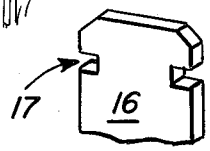
FIG. 6 is a perspective view of the upper end of the waste receptacle's support bar.

Referring to FIG. 1 of the drawings, reference numeral 10 indicates in general, the waste receptacle and support structure with improved cam lock with locking projection as installed on a support post. Any common support structure may be utilized for mounting this waste receptacle and support structure such as a post 12 as shown in FIG. 1. A secondary support structure in the form of a bar 16 is positively fastened to the waste receptacle 18 having a bottom rim 19 and a top open rim 20. As best seen in FIG. 2, the bottom rim 19 normally has a central enclosure therefor 21 which may be of solid disc construction or preferably a disc having apertures, slots, holes, etc. provided therethrough. The rim 20 is completely open for ease in putting waste and debris into the overall waste receptacle. The rims 19 and 20 are positively fastened to the bar 16 and as shown in FIG. 2, screws 22 are used, threaded into the apertures 23 provided in the support bar. Of course, any conventional means such as spot welding, soldering, brazing, nuts and bolts, rivets, etc., may be used.

The primary support bracket consists of the member 30 of sheet steel or other metal which may be appropriately spaced a slight distance from the support post 12 by projections 31 formed by a punching operation from the main body of bracket 30. Apertures 32 are normally also punched into the member 30 at the same point for reception of the lag screws 33 for attaching the primary bracket to the support post. Near the lower end of the primary support bracket spring fingers 34 are also attached by riveting 35 or the like for providing a certain resilient pressure against the bottom of the waste receptacle as best seen in FIG. 1. The lower portion of the primary bracket 30 is also provided with an extending bracket flange 36 having an aperture 37 near the outer end thereof. This aperture 37 in the form of an elongated slot receives the lower end of the bar 16.

Figure 5:
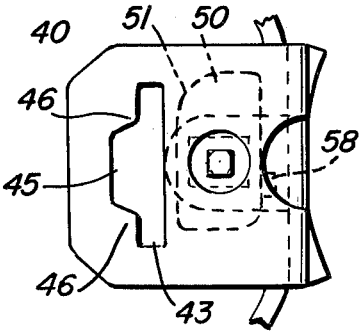
FIG. 5 is a plan view similar to FIG. 4 of the cam locking structure with the trash receptacle and secondary support bar removed.

Again looking at FIG. 2 and at the upper end of bracket 30, the fingers or cam support flanges 24, 26 may be seen. These are preferably stamped from the upper portion of the primary bracket member in a conventional manner. At the very top of member 30 another extending flange portion 40 is provided. This flange portion 40 is provided with a central hole 41 for reception of the skate-type key therethrough which is used to engage with and operate the cam locking structure. Also provided near the outer end of flange projection 40 is an elongated slot 43 similar to the slot 37 provided in the bottom projecting flange 36. This slot 43 also has in communication therewith a shorter slot 45. Together the slots 45 and 43 form an overall T-shaped aperture as best seen in the view of FIG. 5. This T-shaped aperture in association with the recesses 17 provided at the top of the secondary bar 16, as disclosed in the patent above referred to, functions to retain in a positive manner the bracket 16 and waste receptacle 18 as attached thereto. Looking at the various Figures, one can readily visualize that when the upper end of bar 16 is resting in the elongated slot 43, the structure is in the unlocked and removable position and the waste receptacle may be easily removed from the primary support bracket structure. However, when the bar 16 is moved outwardly, that is away from the support 12 and primary bracket attached thereto, and into the smaller aperture 45 with the recesses 17 engaging with and extending over the projections 46 as best seen in FIG. 5, the upper end of the bar 16 will at this time be locked and prevented from being removed from the primary support bracket. Cam structure is used to perform this locking and unlocking engagement of bar 16 with the T-shaped apertures 43, 45.

Figure 3:
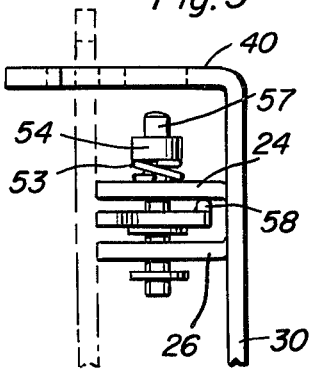
FIG. 3 is a fragmentary portion taken in elevation of the upper part of of the mounting and locking structure per se.
Figure 4:
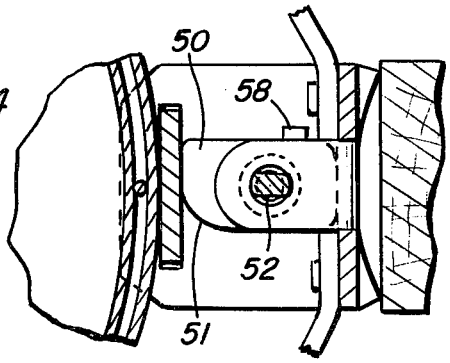
FIG. 4 is a plan view, partly in cross section, taken generally along line 4—4 of FIG. 2.

The cam structure for performing the locking and unlocking function of the primary support bracket and the support bar will now be described in detail. This cam structure consists of a cam member 50 having a tapered or curved portion 51 formed in what essentially is a rectangular plate member having a central aperture therethrough of non-circular shape. As shown in the drawings, this central aperture is of rectangular shape and engages with the key operated support shaft 52 also of rectangular shape. This rotatable support shaft 52 is spring biased in a longitudinal direction by means of the spring 53 between the flange support projection 24 and an enlarged flange portion 54 on the upper body of shaft 52. Conventional snap rings 55 in appropriate recesses provided along the shaft 52 positively retain the shaft as assembled in appropriate apertures in the flanges 24 and 26. The apertures in support flanges 24 and 26 are of sufficient size so as not to interfere with the free rotation of the support shaft 52. The extreme upper end of shaft 52 is provided with a square or otherwise specially configured projection 57 for engagement by a key structure such as indicated in phantom lines in FIG. 2. A common type skate key has been found to be very practical in actual use with a square-type opening provided in said key and a similar square-type projection 57 provided on the shaft 52. Projecting from one edge of the cam member 50 is an upwardly extending projection 58. As can be seen in the view of FIG. 3, when the cam is rotated to the unlocked position, as best seen from the top in FIG. 5, the projection 58 will be against the inner side of support bracket 24 between the two brackets 24 and 26. The spring 53 also will be pressed between the flange member 54 and the upper outer side of support bracket 24. In this unlocked position of FIGS. 3 and 5, the bar support for waste receptacle 18 may be easily put into place or removed from the primary bracket 30. However, when a key is inserted through aperture 41 and into engagement with the square projection 57 of the rotatable shaft 52, and then the key turned in a counterclockwise direction as viewed from the top, the cam taper 51 will engage with the adjacent portion of bar 16 to positively and firmly push the upper end of said bar so that the recesses 17 receive and engage with the portions 46 of the key bar slot 43, 45. Upon the cam member 50 reaching the fully closed and locked position as best seen in FIG. 4, the projecting portion 58 of the cam member will clear the edge of support bracket 24 and due to the resilient bias of spring 53 snap upwardly into locking position. As shown in locked position in FIGS. 2 and 4, the projection 58 will engage with a substantial portion of the edge 24 of the support bracket and thus in a very positive locking manner prevent reverse rotation of the cam member 50. Thus, vibration, hitting, pulling, twisting or tearing at the waste receptacle or post will not in any manner permit the cam member 50 to rotate in a clockwise direction to an unlocked position. Only by inserting a proper key such as that shown in phantom in FIG. 2, and pressing inwardly and downwardly upon the upper end of rotatable shaft 52 against the spring 53 will the device be able to be unlocked. By pushing against spring 53 until such time as projection 58 clears the edge of bracket 24, then the cam 50 may be turned in a clockwise position to the unlocking position thereof.

From the above description, one can readily visualize how this simple and relatively inexpensive improvement in the locking structure of the waste receptacle and associated support brackets therefor greatly improves the usefulness of the overall device, as well as eliminating unwanted removal or damage to same.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In a waste receptacle securable to a support structure, the waste receptacle having a bar secured thereto, the bar having spaced recesses formed in opposite sides thereof at the upper end of said bar, the support structure having a wall bracket mounted thereon, the wall bracket having upper and lower legs projecting therefrom, an opening being formed in the lower leg for removably receiving the lower end of the bar, an opening being formed in the upper leg and including a relatively wide slot portion and a relatively narrow portion, the upper end of the bar being removably receivable within the relatively wide slot portion of the opening in the upper leg, the relatively narrow slot portion of the opening in the upper leg being adapted to receive the upper end of the bar thereinto, the recesses in the upper end of the bar engaging and receiving wall portions of the relatively narrow slot portion of the opening thereinto, spaced support flanges mounted to the wall bracket between said wall bracket and the bar, a locking device mounted on said support flanges and including a cam member mounted for rotation between the support flanges by a key shaft, said key shaft being rotatable to present a first lobe of the cam member against the bar to position and maintain said bar within the relatively narrow slot portion of the opening in the upper leg, the key shaft being further rotatable to present a second lobe of said cam member into opposed relation to the bar to allow the bar to be moved into the relatively wide slot portion of the opening in the upper leg to permit removal of the bar from the openings in the upper and lower legs and thus removal of the waste receptacle from secured relation to the wall bracket and support structure, the improvement comprising:

a projection formed on the upper surface of the cam member, the cam member being carried on the key shaft for rotation therewith;

an enlarged flange member formed on the upper end of the key shaft and spaced from the upper surface of the uppermost support flange secured to the wall bracket, the upper surface of the flange member forming a pressure receiving surface; and, a spring mounted about the key shaft between the upper surface of the uppermost support flange and the lower surface of the enlarged flange member and biasing thereagainst, the spring biasing the projection on the cam member against a side portion of the uppermost support flange when the key shaft and cam member are rotated to present the first lobe of said cam member against the bar, the projection thereby positively locking the bar within the relatively narrow slot portion of the opening in the upper leg, the spring being compressed by pressure exerted against the pressure receiving surface of the enlarged flange member of the key shaft to displace the projection on the cam member downwardly to allow rotation of the key shaft and cam member to present the second lobe of said cam member into opposed relation to the bar to unlock the bar from the wall bracket.

2. The apparatus of claim 1 wherein said first lobe of the cam member is convex in shape to limit rotation of the cam member in a given direction.

3. The apparatus of claim 1 and further comprising retainer plates, one each connectable to the key shaft below the cam member and below the lowermost support flange to maintain the key shaft in rotatably mounted relation to the support flanges.

* * * * *